US006835054B2

(12) United States Patent
Morita

(10) Patent No.: US 6,835,054 B2
(45) Date of Patent: Dec. 28, 2004

(54) OIL PUMP

(75) Inventor: Shoji Morita, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/774,661

(22) Filed: Feb. 10, 2004

(65) Prior Publication Data

US 2004/0161354 A1 Aug. 19, 2004

(30) Foreign Application Priority Data

Feb. 14, 2003 (JP) ..... 2003-036907

(51) Int. Cl.[7] ..... F04C 2/00
(52) U.S. Cl. ..... 418/15; 418/171
(58) Field of Search ..... 418/15, 171, 166, 418/201.1; 137/538

(56) References Cited

U.S. PATENT DOCUMENTS

| | | | | | |
|---|---|---|---|---|---|
| 2,739,538 | A | * | 3/1956 | Witchger | 418/171 |
| 4,443,169 | A | * | 4/1984 | Merz | 418/171 |
| 5,096,397 | A | | 3/1992 | Eisenmann | |
| 5,122,335 | A | | 6/1992 | Eisenmann | |

FOREIGN PATENT DOCUMENTS

| | | | | | |
|---|---|---|---|---|---|
| GB | 1016722 | | * | 1/1966 | 418/15 |
| JP | 05240166 | A | * | 9/1993 | F04C/2/10 |
| JP | 05263770 | A | * | 10/1993 | F04C/2/10 |
| JP | 2530846 | Y2 | | 1/1997 | |
| JP | 2638282 | B2 | | 4/1997 | |
| JP | 3074047 | B2 | | 6/2000 | |

* cited by examiner

*Primary Examiner*—Theresa Trieu
(74) *Attorney, Agent, or Firm*—Foley & Lardner LLP

(57) ABSTRACT

A pump chamber defines a capacity increased in a first certain angle range and decreased in a second certain angle range. An intake port is open in an increase range where the pump chamber moves from a minimum capacity position to a maximum capacity position. A discharge port is open in a decrease range where the pump chamber moves from the maximum capacity position to the minimum capacity position, the discharge port being biased to the minimum capacity position. A seal land portion seals a communication between the intake port and the discharge port via the pump chamber. A reduced portion is defined between a communication portion and the pump chamber. A bypass path connects the communication portion with the discharge port. A relief valve intervened in the bypass path opens the bypass path with a pressure of the communication portion increased to or over a set pressure.

20 Claims, 6 Drawing Sheets

OIL PUMP

BACKGROUND OF THE INVENTION

1. Field of the Invention

The present invention relates to an oil pump. More specifically, a plurality of pump chambers disposed substantially circumferentially in the oil pump under the present invention rotate in accordance with a drive shaft, with a capacity of each of the pump chambers increased substantially sequentially in a first certain angle range and decreased substantially sequentially in a second (remaining) certain angle range.

2. Description of the Related Art

An oil pump is known for a cavitation which may be caused at an intake step with an intake resistance increased. Thereby, the oil pump is ordinarily provided with a flow rate control valve on a discharge side, instead of a narrowed portion (controlling the flow rate) on an intake side, thus returning an excessive oil from the flow rate control valve to the intake side.

With the oil pump having the above system, however, a once-compressed oil is to be partly returned to the intake side without making any operation (function), resulting in a great dynamic loss of the oil pump. For reducing the returned oil from the discharge side, the following is taken into account:

The flow rate is to be controlled on the intake side. In this case, a bubble which may be caused by the possible cavitation is to be smashed slowly and mildly, so as to prevent a failure including an abnormal noise and the like due to the cavitation.

Described hereinafter are related arts disclosing an oil pump for solving the above inconvenience.

Japanese Patent Examined Publication No. 3074047 (=JP3074047B2, equivalent of Patent Number JP5099162) discloses an oil pump (referred to as "INSCRIBED GEAR PUMP in its English abstract). The oil pump is of a trochoid type which substantially sequentially increases a capacity of a pump chamber in a first certain angle range and substantially sequentially reduces the capacity of the pump chamber in a second certain angle range (remaining angle range). An intake port is so formed as to be open substantially in an entire decrease range where the pump chamber moves from a maximum capacity position to a minimum capacity position. A discharge port is so formed as to be open in an increase range where the pump chamber moves from the minimum capacity position to the maximum capacity position, with the discharge port biased to the minimum capacity position. A wall portion of a casing defines a certain section between the maximum capacity position's side of the intake port and the maximum capacity position's side of the discharge port, which section is formed with a seal land portion for sealing a communication between the intake port and the discharge port via the pump chamber. The seal land portion is provided with a check valve. The check valve may open and close a bypass path which communicates the plurality of the pump chambers {facing the seal land portion} with the discharge port. The check valve has a valve body shaped substantially into a plate. The valve body of the check valve has a first side facing the plurality of the pump chambers and a second side biased by means of a spring (biasing means). A pressure of the discharge port is to be applied to the second side of the valve body of the check valve via the bypass path.

When the cavitation is caused in an intake range at a high speed and the like, the capacity of the pump chamber at the seal land portion may be substantially sequentially reduced with the bypass path closed by means of the check valve. As a result, the bubble caused by the cavitation is smashed slowly and mildly.

Moreover, in a state that the cavitation is absent at a low speed and the like, the pressure of the pump chamber facing the seal land portion may rapidly increase. In this state, however, the check valve may open the bypass path, thereby controlling an excessive pressure increase of the pump chamber at the seal land portion.

Japanese Patent Examined Publication No. 2638282 (equivalent of U.S. Pat. No. 5,096,397) discloses a trochoid type oil pump (referred to as "SUCTION-CONTROLLED GEAR RING PUMP") having a function substantially similar to the oil pump under the above Japanese Patent Examined Publication No. 3074047 (=JP3074047B2, equivalent of Patent Number JP5099162).

In place of the one check valve disposed in the seal land portion in such a manner as to stride across the plurality of pump chambers under the Japanese Patent Examined Publication No. 3074047 (=JP3074047B2, equivalent of Patent Number JP5099162), the oil pump under Japanese Patent Examined Publication No. 2638282 (equivalent of U.S. Pat. No. 5,096,397) discloses a check valve which is provided for one of respective walls facing pump chambers. With a pressure of the pump chamber (facing the seal land portion) increased to or over a set pressure thereof at a low speed and the like, the check valve of each of the pump chambers can open a path individually, thereby conveying (relieving or releasing) the pressure of the pump chambers to a discharge port.

BRIEF SUMMARY OF THE INVENTION

According to Japanese Patent Examined Publication No. 3074047 (=JP3074047B2, equivalent of Patent Number JP5099162), the valve body of the check valve strides across the plurality of the pump chambers and forms a part of a side wall of each of the pump chambers. The check valve when closed may allow the pump chambers to become substantially completely independent of each other, thus reducing the capacity. On the other hand, the check valve when opened may promptly (namely, substantially simultaneously with the opening) communicate the pump chambers to the discharge port's side. In this case, however, the opening of the check valve is not necessarily be started at a point in time when the bubble in all the pump chambers is substantially completely smashed. In other words, as the case may be, the check valve may partly open when the bubble in one of the pump chambers (facing the valve body of the check valve) alone is substantially completely smashed, thereby rapidly conveying a high pressure of the discharge port to the other(s) of the pump chambers which contain(s) the remaining bubble caused by the cavitation, resulting in a rapid smashing of the bubble in the other(s) of the pump chambers. In sum, a failure caused by the cavitation cannot be reduced sufficiently.

On the other hand, Japanese Patent Examined Publication No. 2638282 (equivalent of U.S. Pat. No. 5,096,397) with each of the pump chambers having the check valve individually can be free from the above inconvenience. However, the check valve and the path which are to be so provided on a wall portion of a rotor as to correspond to each of the pump chambers may complicate the constitution and make production difficult. Thus, it is less likely to obtain a secured operation.

It is therefore an object of the present invention to provide an oil pump which can reduce a failure including an abnormal noise and the like which may be caused by a cavitation, with the oil pump simplified in constitution.

According to an aspect of the present invention, there is provided an oil pump comprising: 1) a plurality of pump chambers disposed substantially circumferentially and rotatable in accordance with a rotation of a drive shaft, a pump chamber of the plurality of the pump chambers defining a capacity which is substantially sequentially increased in a first certain angle range and substantially sequentially decreased in a second certain angle range, the pump chambers including; a) a first pump chamber, and b) a second pump chamber; 2) an intake port so formed as to be open in at least a part of an increase range where the pump chamber moves from a minimum capacity position to a maximum capacity position, the first pump chamber being free from being open to the intake port; 3) a discharge port so formed as to be open in at least a part of a decrease range where the pump chamber moves from the maximum capacity position to the minimum capacity position, in the decrease range the discharge port being biased to the minimum capacity position's side, the second pump chamber being free from being open to the discharge port; 4) a seal land portion disposed in a certain section between: the maximum capacity position's side of the intake port, and the maximum capacity position's side of the discharge port, the seal land portion forming a stationary wall portion striding across the plurality of the pump chambers, the seal land portion sealing a communication between the intake port and the discharge port via the pump chamber; 5) a communication portion for allowing a mutual communication between the first pump chamber and the second pump chamber of the plurality of the pump chambers which face the seal land portion; 6) a reduced portion defined between the communication portion and the pump chamber; 7) a bypass path connecting the communication portion with the discharge port; and 8) a relief valve intervened in the bypass path and being adapted to open the bypass path with a pressure of the communication portion increased to or over a set pressure of the communication portion.

The other object(s) and feature(s) of the present invention will become understood from the following description with reference to the accompanying drawings.

BRIEF DESCRIPTION OF THE SEVERAL VIEWS OF THE DRAWINGS

FIG. 5 is a schematic of an essential part of a pump chamber 7, according to the embodiment of the present invention, in which:

FIG. 5(A) shows pump chamber 7 free from a communication to an intake port 9 and a communication slit 13, and FIG. 5(B) shows pump chamber 7 free from a communication to communication slit 13 and a discharge port 11.

FIG. 6 shows graphs, in which:

DETAILED DESCRIPTION OF THE EMBODIMENT

In the following, an embodiment of the present invention will be described in detail with reference to the accompanying drawings.

For ease of understanding, the following description will contain various directional terms, such as left, right, upper, lower, forward, rearward and the like. However, such terms are to be understood with respect to only a drawing or drawings on which the corresponding part of element is illustrated.

Constitution

An oil pump according to the embodiment of the present invention is rotatably driven by means of an engine of a vehicle. The oil pump in its entirely is of a trochoid type.

Figure 1:
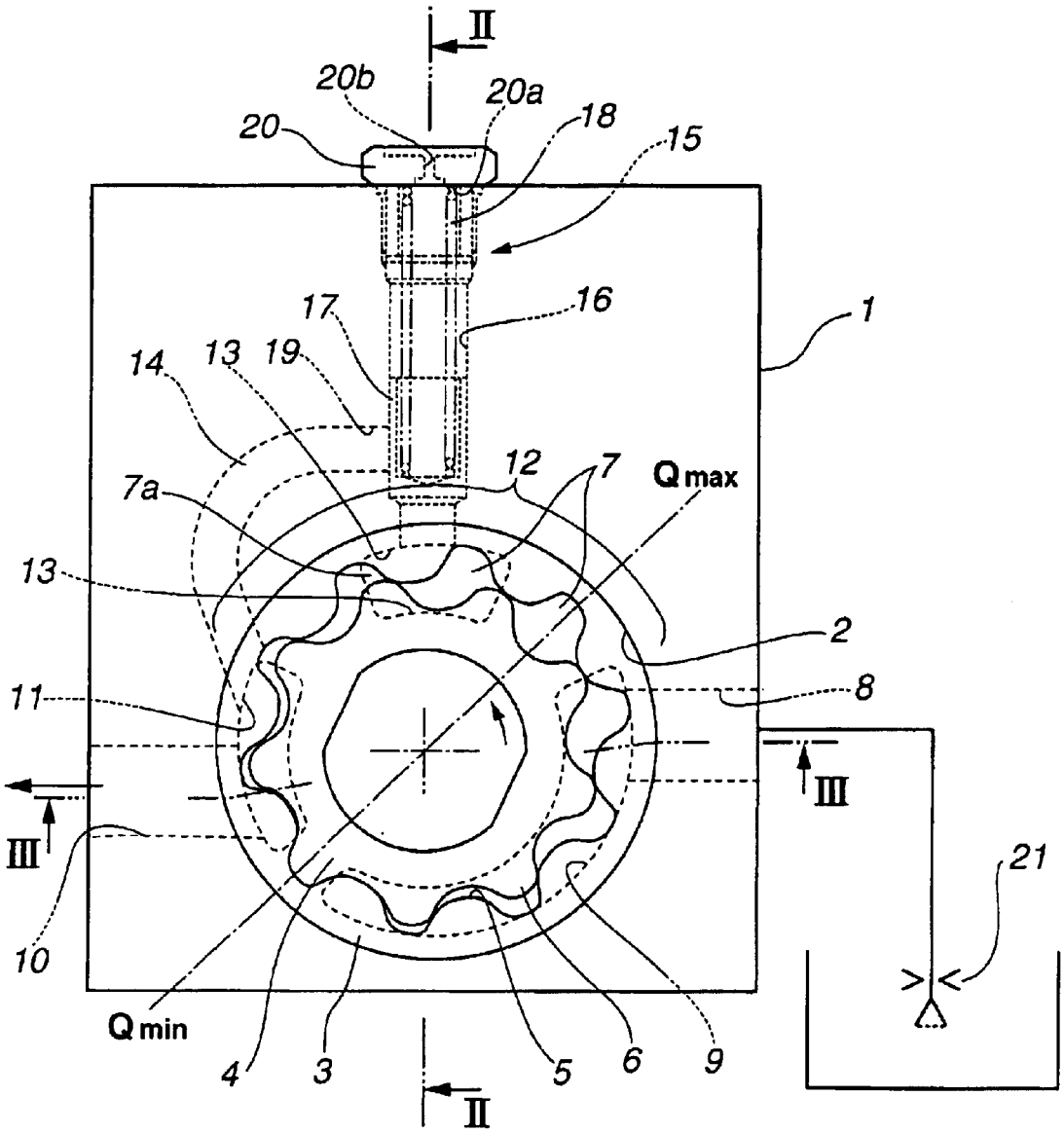
FIG. 1 is a front view of an oil pump, according to an embodiment of the present invention.
Figure 2:
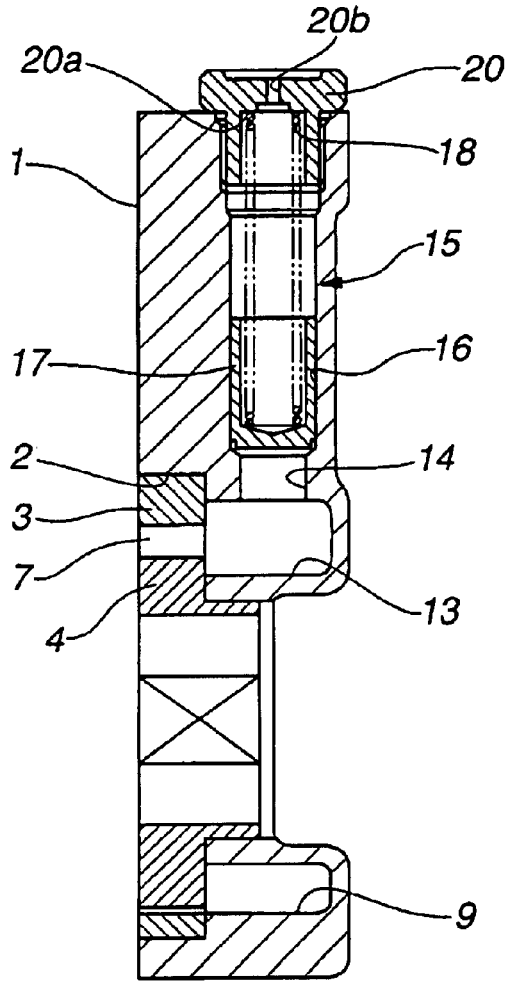
FIG. 2 is a cross sectional view of the oil pump taken along the lines II—II in FIG. 1, according to the embodiment of the present invention.
Figure 3:
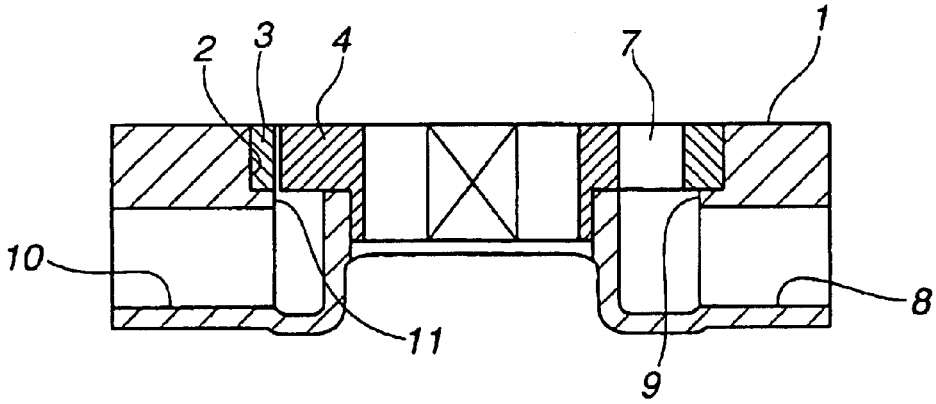
FIG. 3 is a cross sectional view of the oil pump taken along the lines III—III in FIG. 1, according to the embodiment of the present invention.
Figure 4:
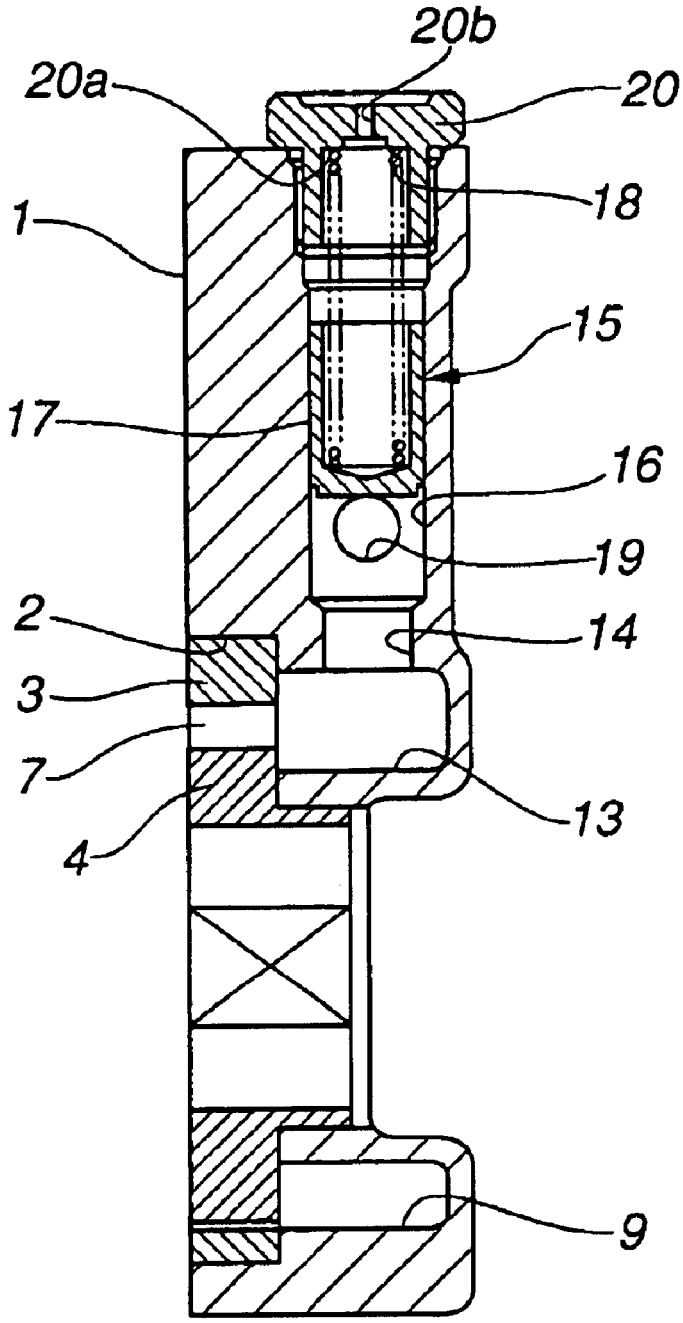
FIG. 4 is a cross sectional view of the oil pump similar to that in FIG. 2, but showing an operation of the oil pump, according to the embodiment of the present invention.

At first, a description is made referring to FIG. 1. There is provided a housing body 1 shaped substantially into a block and formed with a concave portion 2 which is substantially circular. There is provided an outer rotor 3 which is substantially annular, rotatably guided, and received in concave portion 2. There is provided an inner rotor 3 disposed inside outer rotor 3 and rotatably driven by means of a drive shaft (not shown). Housing body 1 has a front face fitted with a cover (not shown) for blocking concave portion 2.

An inner periphery of outer rotor 3 is formed with a plurality of inner teeth 5 profiling a trochoid curve, while an outer periphery of inner rotor 4 is formed with a plurality of outer teeth 6 profiling a trochoid curve. Outer teeth 6 of inner rotor 4 are smaller in number by one than inner teeth 5 of outer rotor 3. Inner rotor 4 has a rotary center thereof which is deviated by a certain deviation from a circular center of concave portion 2, thereby allowing inner rotor 4 and outer rotor 3 to mesh with each other in such a manner as to have a deviation. Herein, outer teeth 6 (of inner rotor 4) smaller in number by one than inner teeth 5 (of outer rotor 3) may have a plurality of contact portions circumferentially, thereby forming a space between the adjacent contact portions.

Outer rotor 3 and inner rotor 4 may slidably contact concave portion 2's base and the cover (not shown). Each of the spaces between the adjacent contact portions may be blocked with concave portion 2's base and the cover (not shown), thereby forming a pump chamber 7 which can vary (increase and decrease) its capacity in accordance with a rotation of inner rotor 4. Pump chamber 7 has its minimum capacity in a position that can cause a deepest meshing between inner rotor 4 and outer rotor 3, and has its maximum capacity in a position substantially diagonal to the position of its minimum capacity. In FIG. 1, a maximum capacity position Qmax (an angular position around a rotary center of inner rotor 4) of pump chamber 7 is defined, while also defined is a minimum capacity position Qmin (an angular position around the rotary center of inner rotor 4) of pump chamber 7.

Concave portion 2 of housing body 1 has an increase range where pump chamber 7 can move from minimum capacity position Qmin to maximum capacity position Qmax. In the increase range, an intake port 9 communicating to an intake path 8 is so formed as to be open.

Concave portion 2 of housing body 1 also has a decrease range where pump chamber 7 can move from maximum capacity position Qmax to minimum capacity position Qmin. In a position biased to minimum capacity position Qmin in the decrease range, a discharge port 11 communicating to a discharge path 10 is so formed as to be open. Intake port 9 and discharge port 11 are, as is seen in FIG. 1 and FIG. 5(A) and FIG. 5(B), shaped substantially into an arc slit in plan view.

Concave portion 2's base has a certain section between maximum capacity position Qmax's side of intake port 9 and maximum capacity position Qmax's side of discharge port 11. The certain section is formed with a seal land portion 12 which is a stationary wall portion striding across a plurality of pump chambers 7. Seal land portion 12 can seal a communication between intake port 9 and discharge port 11 via pump chambers 7. Seal land portion 12 is formed with a communication slit 13 (a communication portion under the present invention) which is shaped substantially into an arc in plan view. The plurality of pump chambers 7 facing seal land portion 12 can communicate with each other through communication slit 13.

Figure 5:
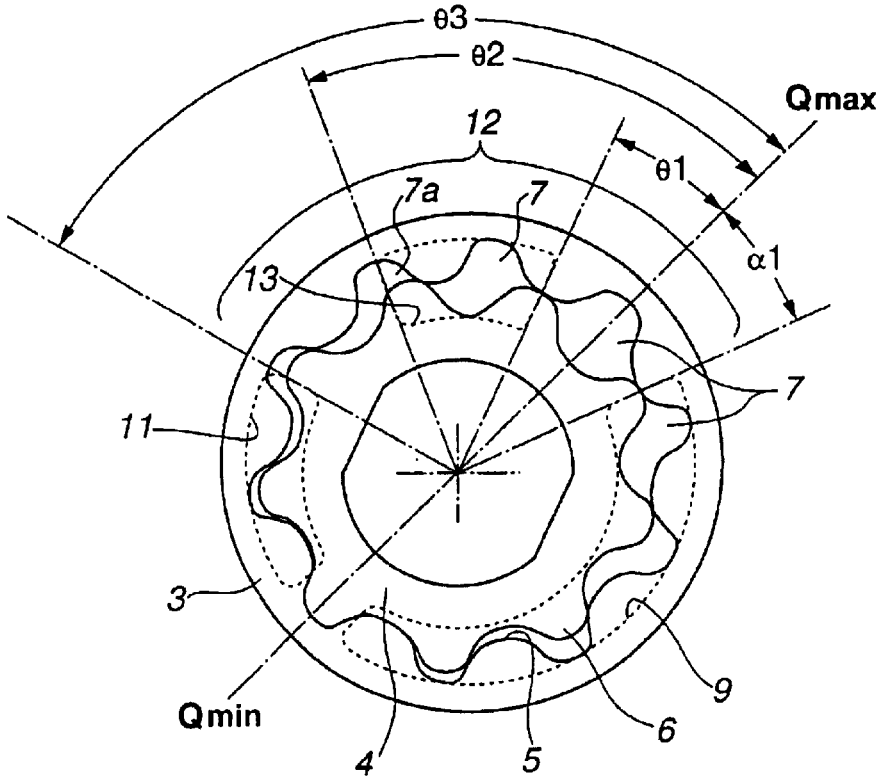
Figure 5:
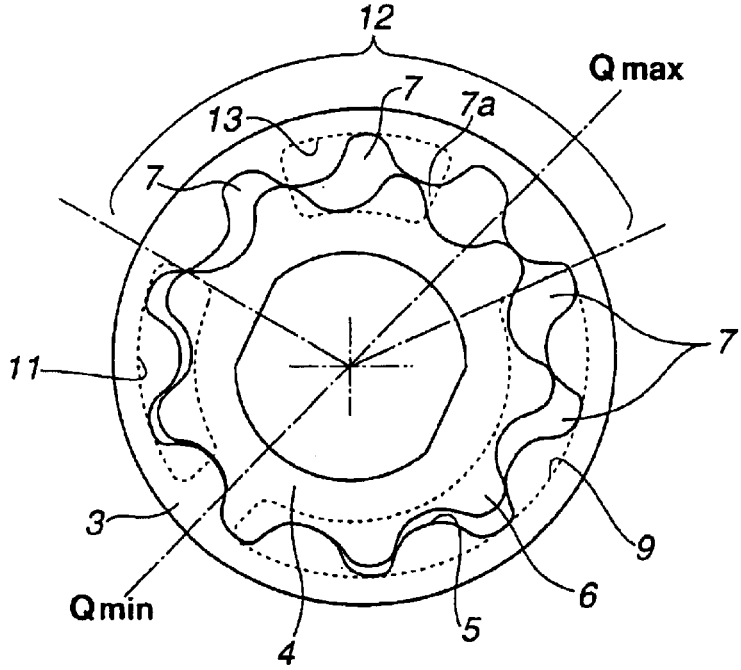

Herein, as is seen in FIG. 5(A) and FIG. 5(B), a circumferential width between intake port 9 and communication slit 13 and a circumferential width between communication slit 13 and discharge port 11 are substantially equal with each other. In addition, the circumferential width between intake port 9 and communication slit 13 is substantially equal to a circumferential width of one pump chamber 7 crossing therebetween, while the circumferential width between communication slit 13 and discharge port 11 is substantially equal to a circumferential width of one pump chamber 7 crossing therebetween. The above substantial equality can prevent a mutual communication between intake port 9 and discharge port 11 through the plurality of pump chambers 7 and communication slit 13.

Herein, each of pump chambers 7 has a first circumferential end and a second circumferential end which are more reduced toward the contact portion of outer tooth 6 with inner tooth 5, thereby forming a reduced portion 7*a*. Pump chamber 7 which is open to communication slit 13 at an end of communication slit 13 may have reduced portion 7*a* to reduce a communication between pump chamber 7 and communication slit 13. Thereby, reduced portion 7*a* can cause a differential pressure to the adjacent pump chamber 7 communicating to communication slit 13.

Communication slit 13 and discharge port 11 are connected via a bypass path 14 which is formed in housing body 1. A relieve valve 15 intervened in bypass path 14 may open bypass path 14 when communication slit 13 has a pressure increased to or over a set pressure thereof. According to the embodiment, relief valve 15 has a valve-opening pressure which is set substantially equal to a pressure of discharge port 11 or slightly lower than the pressure of discharge port 11.

Relief valve 16 includes:

1) a spool receptacle 16 formed in housing body 1 in such a manner as to be open substantially in a center of communication slit 13 which is shaped substantially into an arc and, 2) a spool 17 slidably received in spool receptacle 16, 3) a coil spring 18 (biasing member) intervened between spool 17 and spool receptacle 16's base (upper in FIG. 1), for biasing spool 17 toward communication slit 13, and 4) a drain port 19 formed in a circumferential wall of spool receptacle 16 and communicating to discharge port 11's side.

An oil of communication slit 13 may be introduced to a first end (lower in FIG. 1) of spool 17, thereby applying a pressure of the oil to spool 17, while an atmospheric pressure and a load of coil spring 18 may be applied to a second end (upper in FIG. 1) of spool 17. Spool 17 may be operated in accordance with the pressure of communication slit 13. More specifically, the pressure of communication slit 13 increased to or over the set pressure thereof may open drain port 19 to communication slit 13's side.

Spool receptacle 16's base (upper in FIG. 1) is blocked with an adjustor screw 20 which constitutes an adjustor gear for externally adjusting the valve-opening pressure of relief valve 15. More specifically about this: Adjustor screw 20 has a head end (upper in FIG. 1) fitted with a spring holder 20*a* (otherwise, referred to as "holder") which is shaped substantially into a concave. Externally turning adjustor screw 20 can freely adjust an axial position of spring holder 20*a*. Also shown in FIG. 1 includes an atmospheric hole 20*b* formed in adjustor screw 20, for allowing a communication between spool receptacle 16's base (upper in FIG. 1) and the atmosphere.

In the oil pump according to the embodiment, instead of a flow rate control valve which may be disposed on discharge path 10's side, a narrowed portion 21 for controlling an intake flow rate is fitted to intake path 8, as is seen in FIG. 1.

Operation

With the above constitution of the oil pump according to the embodiment of the present invention, inner rotor 4 rotated together with the drive shaft (not shown) may allow outer rotor 3 to follow the rotation with the contact portions (between outer rotor 3 and inner rotor 4) shifted continuously. In this state, pump chamber 7 may substantially sequentially increase its capacity in the increase range while substantially sequentially decrease its capacity in the decrease range.

Inner Rotor 4 at High Speed

With the oil pump according to the embodiment having intake path 8 narrowed by narrowed portion 21, inner rotor 4 at a high speed may cause a cavitation of oil in pump chamber 7 when the oil is absorbed by intake port 9. Then, the oil containing a bubble at intake port 9 may be filled in pump chamber 7 which is to be moved to seal land portion 12. Then, as is seen in FIG. 5(A), within a rotation angle $\alpha 1$ and a first rotation angle $\theta 1$, pump chamber 7 may be free from a communication to intake port 9 and communication slit 13. Then, as is seen in FIG. 5(B), pump chamber 7 may be open to communication slit 13 from reduced portion 7*a* (front end), thereafter reducing substantially sequentially the capacity of pump chamber 7 toward minimum capacity position Qmin. In this state, pump chamber 7 after passing communication slit 13 may be free from the communication to communication slit 13 and discharge port 11, as is seen in FIG. 5(B). Then, pump chamber 7 may be open to discharge port 11.

Hereinabove, in a time for moving from maximum capacity position Qmax to discharge port 11, two or three pump chambers 7 may substantially simultaneously be opened to communication slit 13 and the thus opened two or three pumps 7 are mutually communicating. In the vicinity of the end of communication slit 13, however, pump chamber 7 may be partly open to communication slit 13. The partly opening of pump chamber 7 may allow reduced portion 7*a* to cause a reducing operation between pump chamber 7 and communication slit 13, thereby causing a differential pressure between adjacent pump chambers 7. With the above, each of pump chambers 7 may substantially continuously make a compression until passing communication slit 13, in which time the bubble in each of pump chambers 7 caused by the cavitation can be smashed slowly and mildly.

With the oil pump as described above, a failure including an abnormal noise and the like (which may be attributable to a rapid smashing of the bubble caused by the cavitation) can be prevented. Moreover, discharge port 11 can discharge an oil which is free from the bubble.

Inner Rotor 4 at Low Speed

On the other hand, inner rotor 4 at a low speed may be unlikely to cause the cavitation at an intake step. Thereby, pump chamber 7 starting decrease of its capacity at seal land portion 12 may rapidly increase the pressure of each of pump chambers 7, thereby increasing the pressure of communication slit 13 to or over the set pressure thereof. At this point in time, relief valve 15 may open drain port 19, thereby conveying (relieving or releasing) a part of the oil of communication slit 13 to discharge port 11's side via bypass path 14. With the above, a failure of excessively increasing the pressure of pump chamber 7 can be prevented.

In a state that the cavitation is caused at the intake step:

The bubble in one (or some) of pump chambers 7 communicating to communication slit 13 is, as the case may be, substantially completely smashed prior to the bubble in the other of pump chambers 7 communicating to communication slit 13. In this state, however, the pressure rapidly increased due to the substantially completely smashed bubble may smash the bubble in the other of pump chambers 7 through communication slit 13. Then, with the bubbles of substantially all pump chambers 7 communicating to communication slit 13 substantially completely smashed, the pressure of communication slit 13 may increase rapidly. Then, with the pressure of communication slit 13 increased to or over the set pressure thereof, relief valve 15 may open bypass path 14, at which point in time the oil of communication slit 13 may be conveyed (relieved or released) to discharge port 11's side.

With the oil pump described above, bypass path 14 can be prevented from opening promptly at the point in time the bubble in one (or some) of pump chambers 7 is substantially completely smashed. Thereby, the bubble remaining in the other of pump chambers 7 can be free from being rapidly smashed, which rapid smashing is a failure caused by the pressure of discharge port 11's side.

With the oil pump according to the embodiment, moreover, the valve-opening pressure of relieve valve 15 is set equal to or over the atmospheric pressure and is set substantially equal to or slightly lower than the pressure of discharge port 11. With the above setting, the pressure of communication slit 13 can be sufficiently increased before relief valve 15 is open, thereby securely smashing the bubble in the oil which is drained from communication slit 13 to bypass path 14.

With the oil pump according to the embodiment, moreover, the atmospheric pressure (a certain low pressure) and the load of coil spring 18 are applied to the second end (upper in FIG. 1) of spool 17, thereby sufficiently reducing the valve-opening pressure of relief valve 15.

Figures 6A, 6B, 6C, 6D:
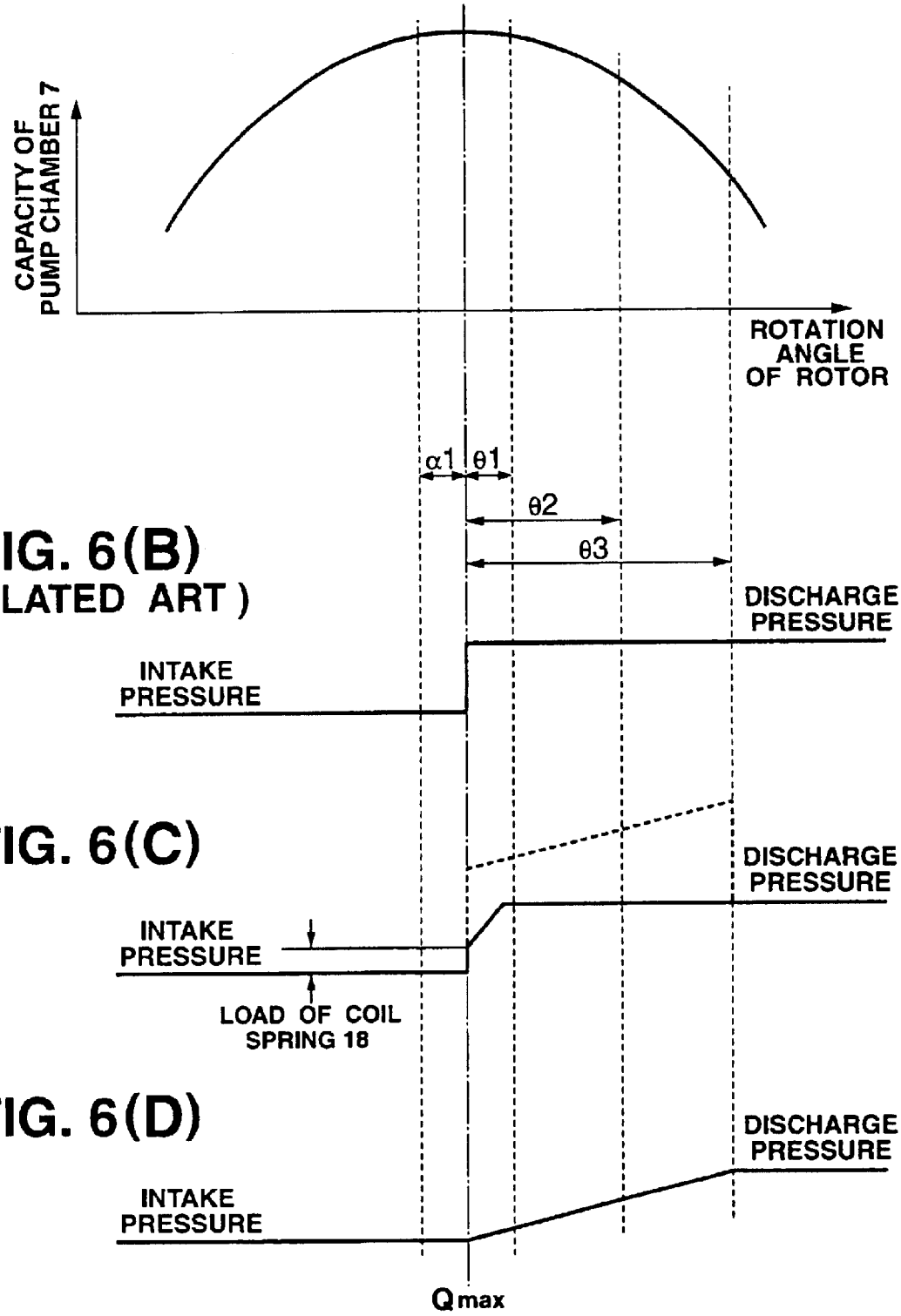
FIG. 6(B) ( RELATED ART )
FIG. 6(A) shows a characteristic of a capacity of pump chamber 7 relative to a rotation angle of a rotor, according to the embodiment of the present invention.
FIG. 6(B) shows a pressure of the oil pump relative to a rotational position of the oil pump, according to a related art.
FIG. 6(C) shows a pressure of pump chamber 7 relative to a rotational position, with a cavitation not caused (namely, bubble removed), according to the embodiment of the present invention.
FIG. 6(D) shows the pressure of pump chamber 7 relative to the rotational position, with the cavitation caused, according to the embodiment of the present invention.

FIG. 6(C) shows a characteristic of the pressure of pump chamber 7 when relief valve 15 starts opening, with the bubble caused by the cavitation removed. The oil pump in this state may feature an actual line in FIG. 6(C) by merely setting a set load of coil spring 18. In FIG. 6(C), a broken line depicts a comparison with both of the pressure of discharge port 11 and the load of coil spring 18 applied to the second end (upper in FIG. 1) of spool 17, increasing unnecessarily the valve-opening pressure (of relief valve 15) to or over the discharge pressure.

FIG. 6(D) shows a characteristic of the pressure of pump chamber 7 in a state that the cavitation is caused at the intake step. In a moment when pump chamber 7 is open to discharge port 11 {namely, at a left terminal end of a third rotation angle θ3 in FIG. 5(A)}, the pressure of pump chamber 7 becomes substantially equal to the pressure of discharge port 11. The above state signifies that the bubble is substantially completely smashed (disappear) on the eve of the opening of pump chamber 7 to discharge port 11. With the following setting, however, the bubble can be smashed slowly and mildly in a sufficient time even at the high speed causing a great amount of the bubbles:

Setting an angle range and the like of seal land portion 12 such that the feature in FIG. 6(D) can be obtained when the drive shaft (not shown) is operating at a maximum speed.

Figure 7:
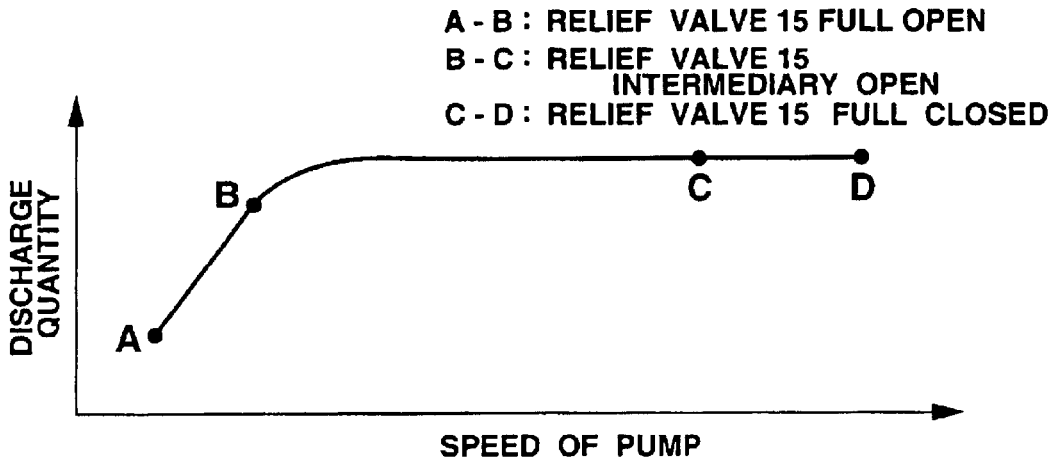
FIG. 7 shows a characteristic of discharge quantity relative to a speed of the oil pump, according to the embodiment of the present invention.

The oil pump according to the embodiment features a discharge characteristic as is seen in FIG. 7.

In the low speed range allowing the intake flow of the oil to be free from the control by narrowed portion 21, the oil pump according to the embodiment is free from the bubble (which may be caused by the cavitation), thereby increasing a discharge flow rate substantially in proportion to the speed of the oil pump.

Over a certain speed of the oil pump, narrowed portion 21 of intake path 8 may cause the cavitation, thereby controlling the increase of the discharge flow rate.

In sum, for controlling the flow rate, the oil pump according to the embodiment is not in need for returning the once-compressed oil to the intake side, resulting in a great reduction of dynamic loss of the oil pump.

Effect

Hereinafter described is effect of the oil pump, according to the embodiment of the present invention.

i) At the maximum speed of the drive shaft (not shown), the cavitation occurring in pump chamber 7 may cause the bubble. The angle range of seal land portion 12 is so set that the bubble can be smashed (disappear) substantially completely on the eve of the opening of pump chamber 7 to discharge port 11.

With the above, even at the maximum speed of the drive shaft (not shown), the abnormal noise can be assuredly prevented by smashing slowly and mildly in a sufficient time the bubble in pump chamber 7.

ii) Narrowed portion 21 is fitted on an upstream side of intake port 9, so as to cause the cavitation in pump chamber 7 in accordance with the speed of the drive shaft (not shown). Narrowed portion 21 is so set as to form a deviation point B in a graph showing the speed of the drive shaft (not shown) relative to the discharge flow rate, as is seen in FIG. 7.

With the above, narrowed portion 21 controlling the intake flow rate can control the discharge flow rate, thereby removing the need for returning a part of the discharge oil (once-compressed for flow rate control) to the intake side, resulting in the great reduction of dynamic loss of a drive source.

iii) The atmospheric pressure is applied to the second end (upper in FIG. 1) of spool 17.

With the above, it is coil spring 18 (biasing member)'s force that is used for setting the valve-opening pressure of relief valve 15, thereby simplifying the setting and making the setting accurate and precise.

iv) Adjustor gear 20 is provided for externally adjusting the valve-opening pressure of relief valve 15.

With the above, the valve-opening pressure of relief valve 15 can be adjusted externally after an assembly of oil pump, thereby achieving the valve-opening pressure adjustment to an actual fitting and assuring an accurate adjustment.

v) Adjustor gear 20 in the point iv) above can adjust the axial position of spring holder 20*a* for holding coil spring 18 (biasing means).

With the above, the valve-opening pressure of spool 17 (of relief valve 15) can be made adjustable, and the set load of coil spring 18 (biasing means) to start its operation can be made intentionally adjustable.

vi) Adjustor gear 20 is constituted of a screw mechanism that can be turned externally.

The thus obtained simplified constitution can bring about a preferred function, thereby reducing cost of device and equipment.

vii) The plurality of pump chambers 7 include:

1) a rotary element (outer rotor 3 and inner rotor 4) varying the capacity of pump chamber in accordance with the rotation of the drive shaft (not shown), and 2) a non-rotary element {concave portion 2's base, and the cover (not shown)} slidably contacting the rotary element (outer rotor 3 and inner rotor 4), thereby constituting a common wall portion of the plurality of pump chambers 7.

Moreover, each of intake port 9, discharge port 1, and communication portion 13 is formed into a slit which is disposed in an inner face of the non-rotary element {concave portion 2's base, and the cover (not shown)}, the inner face facing pump chamber 7's side.

With the above, communication portion 13 formed into the slit like intake port 9 and discharge port 11 can simplify the constitution of the paths, resulting in reduced production cost.

viii) The circumferential width between intake port 9 and communication portion 13 and the circumferential width between communication portion 13 and discharge port 11 are substantially equal with each other. In addition, the circumferential width between intake port 9 and communication portion 13 is substantially equal to the circumferential width of one pump chamber 7 which crosses therebetween, while the circumferential width between communication portion 13 and discharge port 11 is substantially equal to the circumferential width of one pump chamber 7 which crosses therebetween.

With the above, a sufficient length can be secured for communication portion 13 without causing a failure of the mutual communication between communication portion 13 and intake port 9 and the mutual communication between communication portion 13 and discharge port 11, thereby smashing slowly and mildly the bubble (caused by the cavitation in pump chamber 7) in an extensive range.

ix) The oil pump is of the trochoid type having outer teeth 6 of inner rotor 4 and inner teeth 5 of outer rotor 3, the teeth constituting the trochoid curve.

With the above, each of pump chambers 7 is substantially sequentially reduced toward the circumferential end, thus forming reduced portion 7*a*. Reduced portion 7*a* can slowly and mildly vary an opening area (of the end portion of pump chamber 7) relative to communication portion 13 when pump chamber 7 starts opening to communication portion 13 and ends opening to communication portion 13. Reduced portion 7*a* can, thereby, remove the need for defining an otherwise reduced portion between communication portion 13 and pump camber 7, and further reduce fluctuation in the pressure of communication portion 13. Moreover, a relative speed between inner rotor 4 and outer rotor 3 of the trochoid type oil pump is low, thereby reducing a wear which may be caused to outer teeth 6 (of inner rotor 4) and inner teeth 5 (of outer rotor 3) respectively.

Although the present invention has been described above by reference to a certain embodiment, the present invention is not limited to the embodiment described above. Modifications and variations of the embodiment described above will occur to those skilled in the art, in light of the above teachings.

More specifically, according to the embodiment of the present invention, the trochoid type oil pump is described. A vane type oil pump can replace the trochoid type oil pump.

This application is based on a prior Japanese Patent Application No. P2003-36907 (filed on Feb. 14, 2003 in Japan). The entire contents of the Japanese Patent Application No. P2003-36907 from which priority is claimed is incorporated herein by reference, in order to take some protection against mis-translation or omitted portions.

The scope of the present invention is defined with reference to the following claims.

What is claimed is:

1. An oil pump comprising:

1) a plurality of pump chambers disposed substantially circumferentially and rotatable in accordance with a rotation of a drive shaft, a pump chamber of the plurality of the pump chambers defining a capacity which is substantially sequentially increased in a first certain angle range and substantially sequentially decreased in a second certain angle range, the pump chambers including;

a) a first pump chamber, and b) a second pump chamber;

2) an intake port so formed as to be open in at least a part of an increase range where the pump chamber moves from a minimum capacity position to a maximum capacity position, the first pump chamber being free from being open to the intake port;

3) a discharge port so formed as to be open in at least a part of a decrease range where the pump chamber moves from the maximum capacity position to the minimum capacity position, in the decrease range the discharge port being biased to the minimum capacity position's side, the second pump chamber being free from being open to the discharge port;

4) a seal land portion disposed in a certain section between:

the maximum capacity position's side of the intake port, and the maximum capacity position's side of the discharge port, the seal land portion forming a stationary wall portion striding across the plurality of the pump chambers, the seal land portion sealing a communication between the intake port and the discharge port via the pump chamber;

5) a communication portion for allowing a mutual communication between the first pump chamber and the second pump chamber of the plurality of the pump chambers which face the seal land portion;

6) a reduced portion defined between the communication portion and the pump chamber;

7) a bypass path connecting the communication portion with the discharge port; and 8) a relief valve intervened in the bypass path and being adapted to open the bypass path with a pressure of the communication portion increased to or over a set pressure of the communication portion.

2. The oil pump as claimed in claim 1, wherein the relief valve includes:

1) a spool including;

a first end for introducing an oil of the communication portion, a pressure of the thus introduced oil being applied to the first end of the spool, and a second end to which a certain pressure that is lower than the pressure of the discharge port is applied, 2) a spool receptacle for receiving therein the spool, and defining a circumferential wall, 3) a biasing means for biasing the spool from the second end of the spool to the first end of the spool, and 4) a drain port formed in the circumferential wall of the spool receptacle, and communicating to the discharge port's side, and wherein in accordance with the pressure of the communication portion, the spool is adapted to open and close the drain port.

3. The oil pump as claimed in claim 2, wherein at a maximum speed of the drive shaft, a cavitation occurring in the pump chamber causes a bubble, and an angle range of the seal land portion is so set that the thus caused bubble is smashed substantially completely on an eve of an opening of the pump chamber to the discharge port.

4. The oil pump as claimed in claim 2, wherein the plurality of the pump chambers include:

1) a rotary element varying the capacity of the pump chamber in accordance with the rotation of the drive shaft, and 2) a non-rotary element slidably contacting the rotary element, thereby constituting a common wall portion of the plurality of the pump chambers, and wherein each of the intake port, the discharge port, and the communication portion is formed into a slit which is disposed in an inner face of the non-rotary element, the inner face facing the pump chamber's side.

5. The oil pump as claimed in claim 4, wherein a circumferential width between the intake port and the communication portion and a circumferential width between the communication portion and the discharge port are substantially equal with each other, and the circumferential width between the intake port and the communication portion is substantially equal to a circumferential width of one of the pump chambers which crosses therebetween, while the circumferential width between the communication portion and the discharge port is substantially equal to a circumferential width of one of the pump chambers which crosses therebetween.

6. The oil pump as claimed in claim 5, wherein the oil pump is of a trochoid type having an outer tooth of an inner rotor and an inner tooth of an outer rotor, the outer tooth and the inner tooth constituting a trochoid curve.

7. An oil pump comprising:

1) a plurality of pump chambers disposed substantially circumferentially and rotatable in accordance with a rotation of a drive shaft, a pump chamber of the plurality of the pump chambers defining a capacity which is substantially sequentially increased in a first certain angle range and substantially sequentially decreased in a second certain angle range, the pump chambers including;

a) a first pump chamber, and b) a second pump chamber;

2) an intake port so formed as to be open in at least a part of an increase range where the pump chamber moves from a minimum capacity position to a maximum capacity position, the first pump chamber being free from being open to the intake port;

3) a discharge port so formed as to be open in at least a part of a decrease range where the pump chamber moves from the maximum capacity position to the minimum capacity position, in the decrease range the discharge port being biased to the minimum capacity position's side, the second pump chamber being free from being open to the discharge port;

4) a seal land portion disposed in a certain section between:

the maximum capacity position's side of the intake port, and the maximum capacity position's side of the discharge port, the seal land portion forming a stationary wall portion striding across the plurality of the pump chambers, the seal land portion sealing a communication between the intake port and the discharge port via the pump chamber;

5) a communication portion for allowing a mutual communication between the first pump chamber and the second pump chamber of the plurality of the pump chambers which face the seal land portion;

6) a reduced portion defined between the communication portion and the pump chamber;

7) a bypass path connecting the communication portion with the discharge port (11); and 8) a relief valve intervened in the bypass path and being adapted to open the bypass path with a pressure of the communication portion increased to or over a set pressure of the communication portion, the relief valve having a valve-opening pressure for opening the relief valve, the valve-opening pressure being set substantially equal to a pressure of the discharge port.

8. The oil pump as claimed in claim 7, wherein the relief valve includes:

1) a spool including;

a first end for introducing an oil of the communication portion, a pressure of the thus introduced oil being applied to the first end of the spool, and a second end to which a certain pressure that is lower than the pressure of the discharge port is applied, 2) a spool receptacle for receiving therein the spool, and defining a circumferential wall, 3) a biasing means for biasing the spool from the second end of the spool to the first end of the spool, and 4) a drain port formed in the circumferential wall of the spool receptacle, and communicating to the discharge port's side, and wherein in accordance with the pressure of the communication portion, the spool is adapted to open and close the drain port.

9. The oil pump as claimed in claim 8, wherein an atmospheric pressure is applied to the second end of the spool.

10. The oil pump as claimed in claim 9, wherein an adjustor gear is provided for externally adjusting the valve-opening pressure of the relief valve.

11. The oil pump as claimed in claim 10, wherein the adjustor gear adjusts an axial position of a holder for holding the biasing means which is a coil spring.

12. The oil pump as claimed in claim 11, wherein the adjustor gear is constituted of a screw mechanism that is capable of being turned externally.

13. The oil pump as claimed in claim 12, wherein the plurality of the pump chambers include:

1) a rotary element varying the capacity of the pump chamber in accordance with the rotation of the drive shaft, and 2) a non-rotary element slidably contacting the rotary element, thereby constituting a common wall portion of the plurality of the pump chambers, and wherein each of the intake port, the discharge port, and the communication portion is formed into a slit which is disposed in an inner face of the non-rotary element, the inner face facing pump chamber's side.

14. The oil pump as claimed in claim 13, wherein a circumferential width between the intake port and the communication portion and a circumferential width between the communication portion and the discharge port are substantially equal with each other, and the circumferential width between the intake port and the communication portion is substantially equal to a circumferential width of one of the pump chambers which crosses therebetween, while the circumferential width between the communication portion and the discharge port is substantially equal to a circumferential width of one of the pump chambers which crosses therebetween.

15. The oil pump as claimed in claim 14, wherein the oil pump is of a trochoid type having an outer tooth of an inner rotor and an inner tooth of an outer rotor, the outer tooth and the inner tooth constituting a trochoid curve.

16. An oil pump comprising:

1) a plurality of pump chambers disposed substantially circumferentially and rotatable in accordance with a rotation of a drive shaft, a pump chamber of the plurality of the pump chambers defining a capacity which is substantially sequentially increased in a first certain angle range and substantially sequentially decreased in a second certain angle range, the pump chambers including;

a) a first pump chamber, and b) a second pump chamber;

2) an intake port so formed as to be open in at least a part of an increase range where the pump chamber moves from a minimum capacity position to a maximum capacity position, the first pump chamber being free from being open to the intake port;

3) a discharge port so formed as to be open in at least a part of a decrease range where the pump chamber moves from the maximum capacity position to the minimum capacity position, in the decrease range the discharge port being biased to the minimum capacity position's side, the second pump chamber being free from being open to the discharge port;

4) a seal land portion disposed in a certain section between:

the maximum capacity position's side of the intake port, and the maximum capacity position's side of the discharge port, the seal land portion forming a stationary wall portion striding across the plurality of the pump chambers, the seal land portion sealing a communication between the intake port and the discharge port via the pump chamber;

5) a communication portion for allowing a mutual communication between the first pump chamber and the second pump chamber of the plurality of the pump chambers which face the seal land portion;

6) a reduced portion defined between the communication portion and the pump chamber;

7) a bypass path connecting the communication portion with the discharge port (11);

8) a relief valve intervened in the bypass path and being adapted to open the bypass path with a pressure of the communication portion increased to or over a set pressure of the communication portion; and 9) a narrowed portion fitted on an upstream side of the intake port, so as to cause a cavitation in the pump chamber in accordance with a speed of the drive shaft, the narrowed portion being so set as to form a deviation point in a graph showing the speed of the drive shaft relative to a discharge flow rate.

17. The oil pump as claimed in claim 16, wherein at a maximum speed of the drive shaft, the cavitation occurring in the pump chamber causes a bubble, and an angle range of the seal land portion is so set that the thus caused bubble is smashed substantially completely on an eve of an opening of the pump chamber to the discharge port.

18. The oil pump as claimed in claim 17, wherein the plurality of the pump chambers include:

1) a rotary element varying the capacity of the pump chamber in accordance with the rotation of the drive shaft, and 2) a non-rotary element slidably contacting the rotary element, thereby constituting a common wall portion of the plurality of the pump chambers, and wherein each of the intake port, the discharge port, and the communication portion is formed into a slit which is disposed in an inner face of the non-rotary element, the inner face facing the pump chamber's side.

19. The oil pump as claimed in claim 18, wherein a circumferential width between the intake port and the communication portion and a circumferential width between the communication portion and the discharge port are substantially equal with each other, and the circumferential width between the intake port and the communication portion is substantially equal to a circumferential width of one of the pump chambers which crosses therebetween, while the circumferential width between the communication portion and the discharge port is substantially equal to a circumferential width of one of the pump chambers which crosses therebetween.

20. The oil pump as claimed in claim 19, wherein the oil pump is of a trochoid type having an outer tooth of an inner rotor and an inner tooth of an outer rotor, the outer tooth and the inner tooth constituting a trochoid curve.

* * * * *